United States Patent [19]

Icenbice

[11] 4,453,673

[45] Jun. 12, 1984

[54] RANGE-CONTROLLED ROTARY SPRINKLER

[75] Inventor: Howard Icenbice, Norland, Id.

[73] Assignees: Lawrence H. Duffin, Jr.; Alan C. Duffin, both of Burley, Id.

[21] Appl. No.: 347,862

[22] Filed: Feb. 11, 1982

[51] Int. Cl.[3] ..... B05B 3/08

[52] U.S. Cl. ..... 239/236

[58] Field of Search ..... 239/230, 231, 232, 233, 239/DIG. 1, 236

[56] References Cited

U.S. PATENT DOCUMENTS 2,654,635 10/1953 Lazzarini ..... 239/230

3,033,469 5/1962 Green ..... 239/236 X

*Primary Examiner*—John J. Love

*Assistant Examiner*—Mary F. McCarthy

*Attorney, Agent, or Firm*—Paul F. Horton

[57] ABSTRACT

An improved range controlled rotary sprinkler of the type having an impact arm-nozzle assembly including a bearing spring mounted on a bearing nut-sleeve assembly. The improvement includes a cam plate, having an outer contour of desired shape, which is horizontally and rotatably mounted on the nut-sleeve assembly, and a lever with deflector and cam follower. The bearing spring is mounted over the cam plate to place a downward bias on the top surface of the cam plate. The cam plate is provided with a downwardly extending tab which is operable to engage a selected side of the nut-sleeve assembly. The cam plate may be positioned to control the directional range of water spraying from the nozzle by retracting the cam plate against the bearing spring, rotating the cam plate, and releasing the cam plate. The cam follower follows the contour of the cam plate to vary the pitch of the deflector to control the range of spray.

2 Claims, 6 Drawing Figures

RANGE-CONTROLLED ROTARY SPRINKLER

BACKGROUND OF THE INVENTION

1. Field of the Invention

This invention relates to rotary sprinklers having a variable range.

2. Description of the Prior Art

The desirability of controlling the range of rotary sprinklers has long been recognized. Selective control of the direction and range of the sprinkler allows full watering of crop and lawn areas without the unwanted watering of sidewalks, roadways, and the like. In areas of heavy sprinkler irrigation, as in the Western United States, it is important that the amount of water on the land be carefully controlled for proper growth, cost efficiency, and to prevent soil erosion. It is also important that areas such as gravel roadways not be flooded because of road erosion and safety factors. The cam-cam follower invention as disclosed by L. Stanton, U.S. Pat. No. 1,593,918 has proven valuable for controlling the range of a sprinkler. For irrigational purposes, the impact or impulse type sprinkler is now heavily in use. R. D. Cooney has shown one method of using the cam-cam follower arrangement with impulse or impact type sprinklers. Other relevant patents include those of Manning, U.S. Pat. No. 2,565,926; Kennedy, U.S. Pat. No. 2,780,488; Kennedy, U.S. Pat. No. 2,999,643; Chow, U.S. Pat. No. 3,464,628; and Mullen, U.S. Pat. No. 3,405,871.

The primary disadvantages associated with the present art is that the cam is usually complicated, not readily adjustable, not easily removable, and not carried by the sprinkler head itself.

SUMMARY OF THE INVENTION

The present invention is an improved range-controlled rotary sprinkler of the impact type which overcomes the disadvantages of the sprinklers found in the prior art. The invention includes a cam-cam follower arrangement which is entirely mounted on the sprinkler head for efficient, maintenance-free operation. A precise description of the invention may be found in the appended claims.

It is therefore a primary object of the present invention to provide an improved range-controlled rotary sprinkler of the impact, cam-cam follower type which includes a cam plate which is carried by the bearing assembly and which is readily adjustable to a plurality of positions for controlling the directional range of sprinkling.

More particularly, it is an object of the present invention to provide an improved range-controlled rotary sprinkler having a spring-loaded cam plate which is readily rotatable to a selected position relative to the bearing sleeve.

Additional objects and advantages will become apparent and a more thorough and comprehensive understanding may be had from the following description taken in conjunction with the accompanying drawings forming a part of this specification.

DETAILED DESCRIPTION OF THE INVENTION

Figure 1:
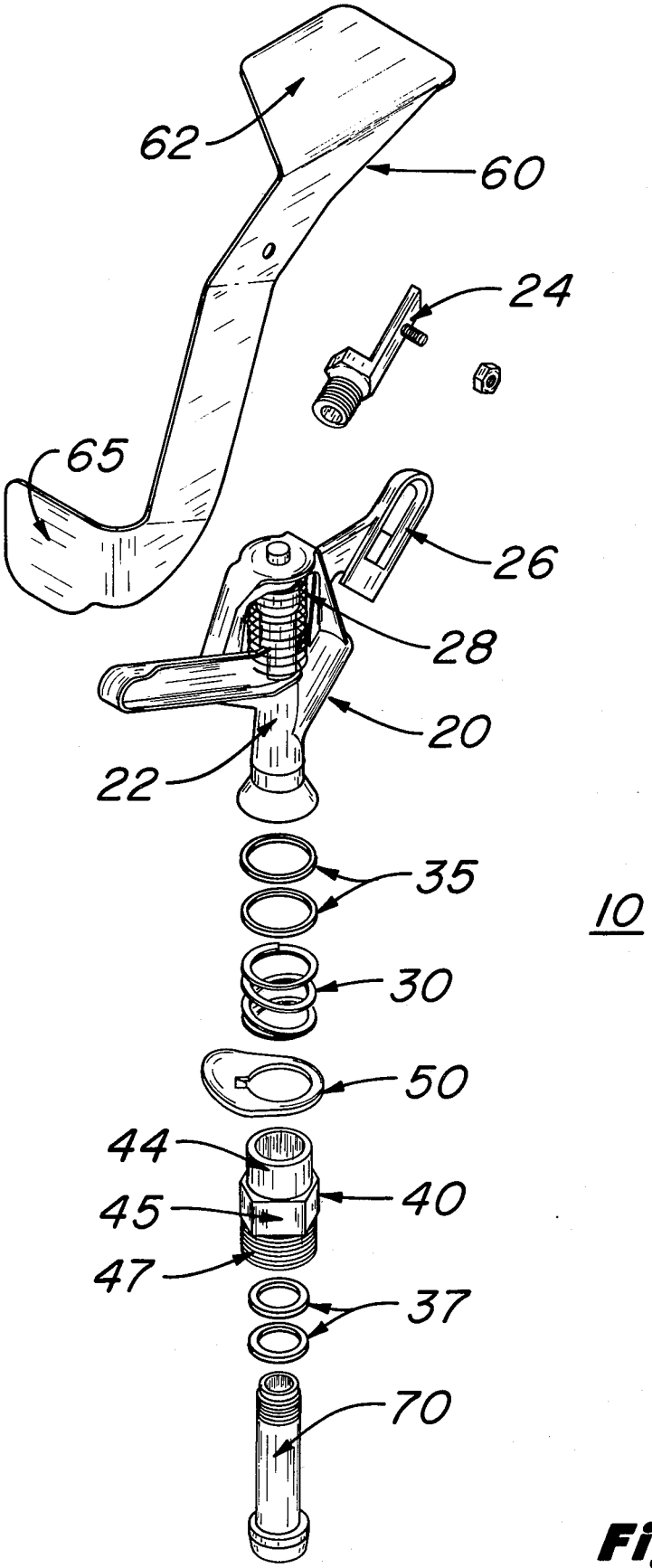
FIG. 1 is an exploded perspective view of a preferred embodiment of the improved rotary sprinkler of the present invention.
Figure 2:
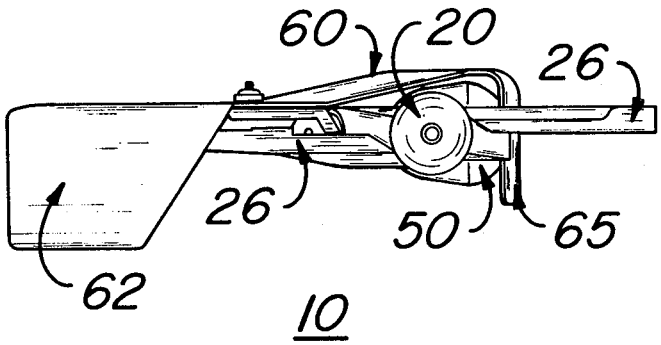
FIG. 2 is a plan view of the sprinkler.
Figure 3:
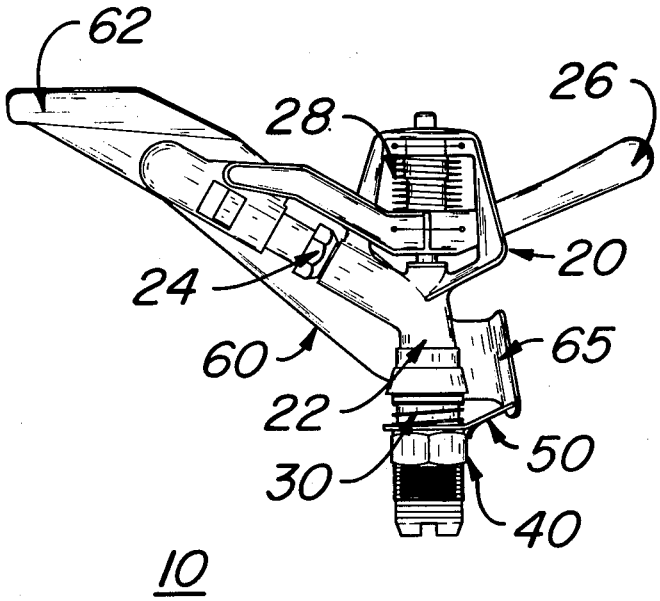
FIG. 3 is a side elevation of the sprinkler, shown assembled.

Referring now to the drawings, and, more particularly, to FIGS. 1, 2, & 3, an embodiment to be preferred of an improved range-controlled rotary sprinkler 10 of the type having an impact arm-nozzle assembly 20 including a bearing spring 30 mounted on a bearing nut-sleeve assembly 40 and including as elements of the invention a cam plate 50 and a lever 60.

The arm-nozzle assembly 20 includes a body portion 22, a nozzle 24, impact arm 26, and a tension spring 28 connected between the pivotal arm 26 and body 22 urging the arm to engage the nozzle, as is conventional. Body portion 22 threadably engages bearing nipple 70 and includes an internal bore for conducting water flow from the nipple through the nozzle. The arm-nozzle assembly is freely rotatable on bearing nut-sleeve assembly 40 by means of appropriate upper coupling washers and rings, designated generally by the numeral 35 and lower coupling washers and rings 37. Arm 26 is provided at one end, adjacent the nozzle, with a cup-shaped portion which contacts emerging water to pivot the arm against the tension of spring 28 causing repeated impact between arm and nozzle to rotate arm-nozzle assembly 20 relative to bearing sleeve assembly 40 to produce a circular spraying pattern. A compression spring 30 is conventionally provided between upper ring and washers 35 and nut 45 of bearing assembly 40 to hold the upper ring and washers 35 tightly against the base of body portion 22 and to hold lower ring and washers 37 tightly against the crown of bearing nipple 70.

Bearing nut-sleeve aasembly 40 includes a sleeve portion 44, a nut 45 generally in the form of a hex-nut, and a threaded portion 47. Sleeve 44 is carried on and receives the stem of nipple 70. Nut 45 may be integral with the sleeve and formed of a single cast. Threaded portion 47 is operable to engage a threaded conduit, not shown, and therefore sleeve assembly 40 is held in a stationary position relative to the conduit or base which it might engage.

Figure 4:
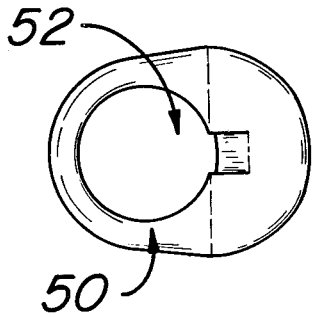
FIG. 4 is a plan view of the cam plate of the present invention.
Figure 5:
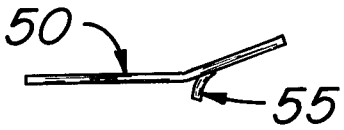
FIG. 5 is a side elevation of the cam plate of FIG. 4.

In accordance with the improvement of the present invention, the rotary sprinkler is provided with a cam plate 50 which is horizontally and rotatably mounted on the exterior wall of sleeve 44 by means of aperture 52 extending vertically therethrough. The exterior wall of sleeve 44 is received by the aperture so that the cam plate may also be moved vertically relative to the sleeve. Cam plate 50 is provided with a downwardly extending tab or projection 55 which is engageable with a selected planar side of nut 45 of bearing assembly 40. Cam plate 50 may have an outer edge of any desired contour to provide a sprinkling pattern of similar shape and may be planar or may include upward or downward bends, as shown in FIGS. 4 and 5, expediting engagement with cam follower 65. Plate 50 is mounted directly below compression spring 30 so that spring 30 places a downward bias on the plate to hold the plate firmly against the top surface of nut 45 and to thereby hold tab 55 securely against a selected side of the nut.

The resiliancy of spring 30 also allows the plate to be moved upwardly on and to be rotated relative to sleeve 44 for positioning of the cam plate relative to bearing assembly 40, in general, and nut 45, in particular, for controlling the directional range of water spraying from nozzle 24.

Also in accordance with the improvement of the present invention, the rotary sprinkler is provided with a lever 60 which is pivotally mounted to nozzle 24 of nozzle assembly 20. Lever 60 includes at one end a deflector portion 62 which is horizontally positioned to downwardly deflect, as required, water emerging from nozzle 24 and at the other end a cam follower 65 which is vertically positioned so as to engage the outer contoured edge of cam plate 50. It will be seen, then, that as the cam follower moves downwardly the deflector moves upwardly giving greater range to the emerging water. Conversely, as cam follower moves upwadly the deflector plate moves downwardly shortening the range of the spray.

In operation, cam plate 50 is inserted between spring 30 and the top of nut 45 by unscrewing nipple 70 from body portion 22 of assembly 20, removing washers and rings 35 and spring 30, placing cam plate 50 with tab 55 extending downwardly, replacing spring and washers and rethreading nipple 70 into body portion 22 of assembly 20. Cam plate 50 is then rotated by pushing upwardly against the bottom of the plate to compress spring 30. The cam plate is then rotated to a selected position and released. Compression spring 30 places a downward bias on plate 50 to hold the plate firmly against the top surface of nut 45 with tab 55 engaging a particular planar side of hex-nut 45.

Figure 6:
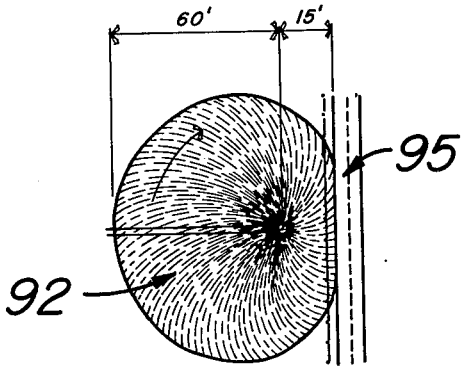
FIG. 6 is a spray pattern using the cam plate of FIGS. 4 and 5.

Lever 60 is pivotally attached to nozzle 24 by means of a nut-bolt assembly engaging an aperture drilled or formed in the nozzle. Cam follower 65, in following the contour of cam plate 50, causes deflection plate 62 to pivot upwardly and downwardly to form a spray pattern substantially in the form of the spray pattern shown in FIG. 6.

Having thus described in detail a preferred embodiment of the present invention, it is to be appreciated and will be apparent to those skilled in the art that many physical changes could be made in the apparatus without altering the inventive concepts and principles embodied therein. The present embodiment is therefore to be considered in all respects as illustrative and not restrictive, the scope of the invention being indicated by the appended claims rather than by the foregoing description, and all changes which come within the meaning and range of equivalency of the claims are therefore to be embraced therein.

I claim:

1. An improved range controlled rotary sprinkler of the type having an impact arm-nozzle assembly including a bearing spring mounted on a bearing nut-sleeve assembly, wherein the improvement comprises:

a cam plate having a pre-selected outer contour and having an aperture therethrough, said cam plate horizontally and rotatably mounted on said bearing assembly with the sleeve of the bearing assembly received in the aperture of said cam plate; said cam plate provided with a downwardly projecting tab operable to engage a selected side of the bearing assembly nut; the bearing spring engageable with the top surface of said cam plate permitting retraction and rotation of said cam plate and placing a downward bias on said cam plate to hold said cam plate in a stationary position relative to the bearing assembly for controlling the directional range of water spraying from the nozzle; and a lever pivotally mounted to the nozzle, said lever provided at one end with a deflector and at an opposing end with a cam follower adapted to follow the outer contour of said cam plate to control the pitch of the deflector and to thereby control the range of water spraying from the nozzle.

2. An improved range-controlled rotary sprinkler of the type having an impact arm-nozzle assembly and a bearing spring mounted on a bearing nut-sleeve assembly, wherein the improvement comprises:

a hand-adjustable, spring biased cam plate having a preselected outer contour and having an aperture therethrough, said cam plate horizontally and rotatably mounted on said bearing assembly, the aperture of said cam plate receiving the sleeve of said bearing assembly, said bearing spring placing a downward bias on said cam plate, and said cam plate including at least one downwardly extending projection operable to engage a portion of said bearing assembly to hold said cam plate in a stationary position relative to said bearing assembly; and a lever pivotally mounted to the nozzle, said lever provided at one end with a deflector and at an opposing end with a cam follower adapted to follow the outer contour of said cam plate to control the pitch of the deflector and to thereby control the range of water spraying from the nozzle.

* * * * *